US007935298B2

(12) United States Patent
McHugh et al.

(10) Patent No.: US 7,935,298 B2
(45) Date of Patent: May 3, 2011

(54) METHOD OF PRODUCING FIBERS BY ELECTROSPINNING AT HIGH PRESSURES

(75) Inventors: Mark McHugh, Richmond, VA (US); Zhihao Shen, Richmond, VA (US); Diane Gee, Richmond, VA (US); Georgios Karles, Richmond, VA (US); Jose Nepomuceno, Beaverdam, VA (US); Gary Huvard, Chesterfield, VA (US)

(73) Assignee: Virginia Commonwealth University, Richmond, VA (US)

( * ) Notice: Subject to any disclaimer, the term of this patent is extended or adjusted under 35 U.S.C. 154(b) by 1005 days.

(21) Appl. No.: 10/596,318

(22) PCT Filed: Dec. 23, 2004

(86) PCT No.: PCT/US2004/043096

§ 371 (c)(1),
(2), (4) Date: Apr. 10, 2007

(87) PCT Pub. No.: WO2005/064047

PCT Pub. Date: Jul. 14, 2005

(65) Prior Publication Data

US 2008/0018015 A1 Jan. 24, 2008

Related U.S. Application Data

(60) Provisional application No. 60/531,675, filed on Dec. 23, 2003.

(51) Int. Cl.
*D06M 10/00* (2006.01)
*H05B 7/00* (2006.01)

(52) U.S. Cl. ..... 264/465; 264/211.16; 425/174.8 E

(58) Field of Classification Search ..... 264/211.16, 264/465; 425/174.8 E
See application file for complete search history.

(56) References Cited

U.S. PATENT DOCUMENTS

2003/0116293 A1 6/2003 Xue et al.
2003/0168756 A1 * 9/2003 Balkus et al. ..... 425/174.8 E X
2004/0094873 A1 * 5/2004 Dubson et al. ..... 264/465

FOREIGN PATENT DOCUMENTS

JP 2004-162215 6/2004

* cited by examiner

*Primary Examiner* — Leo B Tentoni
(74) *Attorney, Agent, or Firm* — Whitham Curtis Christofferson & Cook, PC

(57) ABSTRACT

A process of making fibers by electrostatic spinning includes the use of a mixing vessel (10), a piston (15) for pressurizing the polymer, carbon dioxide sources (20) for lowering the viscosity of the polymer or pressurizing the collection vessel (35), a pressure generator (25), view ports (30), a target (36), a spinning needle (40), a camera/TV recorder (45) and a voltage source (50).

26 Claims, 7 Drawing Sheets

METHOD OF PRODUCING FIBERS BY ELECTROSPINNING AT HIGH PRESSURES

CROSS REFERENCE TO RELATED APPLICATIONS

This application claims the benefit of provisional application, Ser. No. 60/531,675, filed Dec. 23, 2003, the entire disclosure thereof being incorporated herein.

FIELD OF THE INVENTION

This invention relates to the production of fibers by electrospinning and more particularly to a process for electrostatically spinning polymeric formulations under pressure in a pressurized collection vessel.

BACKGROUND OF THE INVENTION

In the electrospinning process, a fiber-forming polymer is supplied to an electrically charged capillary flow tube in the form of a liquid at a relatively low viscosity. Volatile organic compounds are normally used to solvate the polymer to provide a relatively low viscosity solution or dispersion.

The use of volatile organic solvents which evaporate during electrospinning can lead to environmental problems. Moreover, the removal of residual amounts of organic solvents in the fibers increases the cost of the overall operation. Also, some polymeric solutions and dispersions have viscosities which are too high to enable economic production of fibers by electrospinning.

SUMMARY OF THE INVENTION

Methods are provided for the production of polymeric fibers by electrospinning a polymeric formulation at pressures above atmospheric in the presence of at least one pressurized fluid. The method generally involves electrospinning a composition containing a fiber-forming polymer optionally dissolved or dispersed in an organic solvent and/or containing a pressurized or supercritical fluid into a collection vessel containing a pressurized fluid, and collecting the polymeric fibers which are essentially free of organic solvent.

DETAILED DESCRIPTION OF THE PREFERRED EMBODIMENTS

Figure 1:
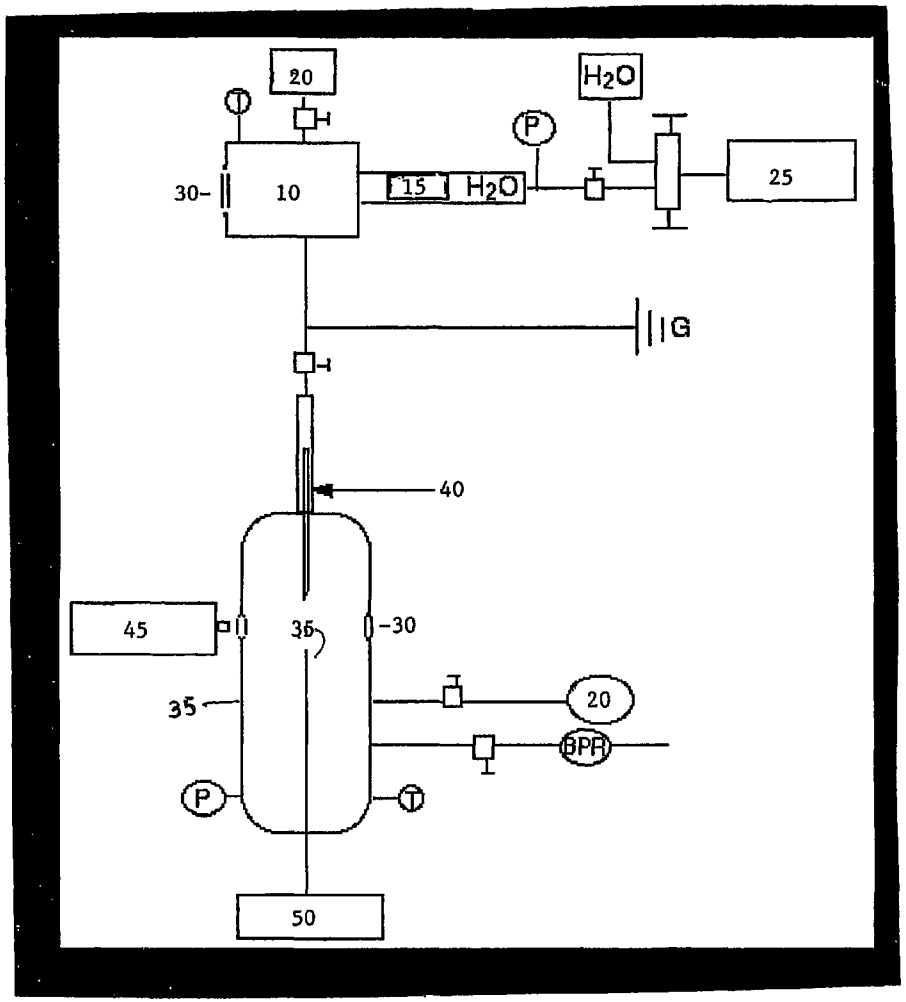
FIG. 1 shows an apparatus suitable for electrospinning polymeric formulations into fibers.

As used herein, the term "electrospinning," also known as "electrostatic spinning," includes various processes for forming polymeric fibers including nanofibers and microfibers by expressing a liquid polymeric formulation through a capillary, syringe or similar implement (referred to herein as a flow tube) under the influence of an electrostatic field and collecting the so-formed fibers on a target.

As used herein, the term "supercritical fluid" (SCF) is intended to encompass a material that is at a temperature and pressure such that the material is at, above, or slightly below, its "critical point." As used herein, the "critical point" of a material is the transition point at which the liquid and gaseous states of that material merge into each other and represents the combination of the critical temperature and critical pressure for that material. The "critical temperature," as used herein, is defined as the temperature above which a gas cannot be liquefied by an increase in pressure. The "critical pressure," as used herein, is defined as that pressure which is just sufficient to cause the appearance of two phases at the critical temperature.

As used herein, a "compressed fluid" is a fluid which may be in its gaseous state, its liquid state, or a combination thereof, or is a supercritical fluid, depending upon (i) the particular temperature and pressure to which it is subjected, (ii) the vapor pressure of the fluid at that particular temperature, and (iii) the critical temperature and critical pressure of the fluid. As used herein, a "subcritical fluid" is a compressed fluid that is at a temperature and pressure at which it is not a supercritical fluid, whether it be a liquid, a gas, or a gas-liquid mixture. As used herein, the term "organic solvent" is a compound which is in the liquid state at a temperature of 25° C. and one atmosphere absolute pressure. As used herein, "non-volatile" means liquids which have a vapor pressure below one atmosphere.

In one embodiment, a pressurized polymer formulation optionally containing an organic solvent and/or a pressurized or supercritical fluid is electrospun into a pressurized collection vessel such that polymer fibers are formed essentially free of said organic solvent. In another embodiment, a liquid polymeric formulation containing at least one fiber-forming polymer dissolved or dispersed in at least one organic solvent is electrospun into a collection vessel such that polymer fibers are formed on a target in the collection vessel, the interior of the collection vessel containing a pressurized or supercritical fluid and the collected fibers being essentially free of the organic solvent which has been extracted by the pressurized or supercritical fluid. In another embodiment, a pressurized pure polymer melt optionally containing a pressurized or supercritical fluid is electrospun into the pressurized collection vessel.

The polymers which can be electrospun in accordance with the presently disclosed process include those which are fiber-forming and optionally capable of being dissolved or dispersed in organic compounds to provide polymeric formulations having a viscosity suitable for electrospinning. Illustrative polymers include, but are not limited to, polyolefins such as polyethylene, polypropylene, polyisobutylene, and ethylene-alpha-olefin copolymers; acrylic polymers and copolymers such as polyacrylates, polymethylmethacrylate, polyethylacrylate, and esters thereof; vinyl halide polymers and copolymers such as polyvinyl chloride; polyvinyl ethers such as polyvinyl methyl ether; polyvinylidene halides, such as polyvinylidene fluoride and polyvinylidene chloride; polyacrylonitrile; polyvinyl ketones; polyvinyl amines, polyvinyl aromatics such as polystyrene; polyvinyl esters, such as polyvinyl acetate; copolymers of vinyl monomers with each other and olefins, such as ethylene-methyl methacrylate copolymers, acrylonitrile-styrene copolymers, ABS resins, and ethylene-vinyl acetate copolymers; natural and synthetic rubbers, including butadiene-styrene copolymers, polyisoprene, synthetic polyisoprene, polybutadiene, butadiene-acrylonitrile copolymers, polychloroprene rubbers, polyisobutylene rubber, ethylene-propylene-diene rubbers, isobutylene-isoprene copolymers, and polyurethane rubbers; polyesters, such as polyethylene terephthalate; polycarbonates; polyethers; polyamides; polyvinylpyrrolidone; fluoropolymers, etc. Other polymers which can be electrospun include refractory polymers, polylactic acid and copolymers of lactic acid and glycolic acid.

By use of a pressurized formulation and pressurized collection vessel, polymeric formulations can be electrospun despite viscosities which are too high for successful electrospinning under ambient conditions. Moreover, non-volatile organic solvents can be used. In conventional electrospinning techniques, the solvent for the polymer must be sufficiently volatile to be vaporized during electrospinning at atmospheric pressure. A pressurized environment and the use of pressurized fluids enables one to electrospin refractory polymers, i.e. polymers that are difficult to dissolve in solution or that do not melt even at high temperatures.

The pressurized or supercritical fluid in the collection vessel may be any liquid, gas or compound that has solvating properties at high pressure for the organic solvent used to dissolve or disperse the polymer. Illustrative fluids include carbon dioxide, $N_2O$, $SF_6$, ethylene, argon, xenon, ammonia, hydrocarbons, halogenated hydrocarbons, dimethyl ether and water. Suitable hydrocarbons include alkanes such as ethane and propane and alkenes such as ethylene and propylene, and halogenated hydrocarbons such as chlorotrifluoromethane, fluoroform, perfluoromethane, and other freons. Several of the supercritical fluids are environmentally benign such as carbon dioxide, xenon, argon and $N_2O$. The critical temperature and critical pressure for achieving a supercritical fluid state is generally known for each of the above-described fluids. The critical temperature and critical pressure for other fluids can be determined by techniques known in the art. $CO_2$ is most preferred due to its low cost, low toxicity and low critical temperature. If desired, such pressurized or supercritical fluids could be added to the polymer formulation prior to being electrospun into the collection vessel. In the case where a polymer formulation is used which is free of a solvent, a pressurized or supercritical fluid can be used to pressurize the polymer formulation and the same fluid can be used in the collection vessel. For example, supercritical carbon dioxide can be used to pressurize a solvent-free polymeric formulation or pure polymer melt which is electrospun into a collection vessel wherein supercritical carbon dioxide is used to pressurize the interior of the collection vessel.

In a non-pressurized electrospinning process, a liquid polymer formulation flows through a delivery flow tube (e.g., needle, syringe or other capillary device) that is attached to a high voltage source and the formulation is electrospun onto a target. For example, an electron flux from a target to a needle draws the polymer formulation through the open space between the needle and target. Evaporation of solvent from the polymer formulation during this needle-to-target transfer produces polymer fibers. When the electrospinning process is unsuccessful, the polymer arrives at the target as a droplet or just drips from the needle tip. In a pressurized process, a pressurized or supercritical fluid (SCF) is added to the spinning (collection) vessel housing the needle and the target so that as fiber is produced, the pressurized fluid or the SCF effectively removes (extracts) the solvent from the polymer more readily and more quickly than if spinning into an ambient environment. By adjusting operating conditions, as dictated by the phase behavior of the pressurized fluid or of the supercritical fluid and the solvent used to dissolve the polymer, it is possible to create solid polymeric fibers essentially free of the solvent. Similar results can be achieved in the case where the polymer formulation does not include a solvent.

The temperature and pressure in the electrospinning (collection) vessel can be adjusted to maintain subcritical or supercritical conditions. Suitable operating temperatures employed in the electrospinning process range from sub-ambient temperatures up to 200° C. and are actually limited only by the decomposition temperature and stability of the polymer. A preferred temperature range is about 10° C. to about 200° C., more preferably about 10° C. to 100° C., and most preferably about 20° C. to 60° C.

Operating pressures in the collection vessel and a mixing vessel (in which the polymer formulation is contained prior to being electrospun), if used, may range from about 50 psig up to about 10,000 psig. However, pressures in excess of about 2000-3000 psig generally are unnecessary. A preferred range is about 50 psig to 3000 psig, more preferably about 50-2000 psig, most preferably about 50-1000 psig. Preferably, the pressure is below the pressure at which the polymer begins to dissolve in the pressurized or supercritical fluid. A higher pressure in the mixing vessel than in the collection vessel can be used to deliver the polymeric formulation through the flow tube into the collection vessel.

In a further embodiment, the electrospinning apparatus can include a pressurized mixing vessel where the polymer formulation and a pressurized or SCF are admixed under subcritical or supercritical conditions before being sprayed into the pressurized electrospinning (collection) vessel. The organic solvent used to dissolve or disperse the fiber-forming polymer is dissolved in the pressurized or supercritical fluid. The pressurized fluid or SCF may assist in lowering the viscosity of viscous polymeric formulations such that the formulations are more conducive to electrospinning. In fact, the pressurized fluid or SCF may also assist in lowering the viscosity of pure, melt polymer so that a liquid solvent would not be required. Thus, non-volatile solvents, very viscous solvents, very viscous polymer-solvent mixtures, and very viscous polymer melts can be tolerated in the electrospinning process.

The organic solvent can be removed from the jet of polymeric formulation issuing from the tip of the capillary before the polymer fibers reach the target. In the presently disclosed method, the collected fibers are essentially free of the organic solvent used to dissolve or disperse the polymer. It has also been observed that the pressurized or supercritical conditions maintained in the electrospinning apparatus have an effect on the morphology of the fibers. Thus, by varying temperatures and/or pressures, fibers can be obtained which are discontinuous and flat or are open-cell with a surrounding ruptured or non-ruptured skin or have an open-cell internal structure with no surrounding skin. By controlling process parameters it is possible to produce a desired pore size in the electrospun fibers.

Figure 3:
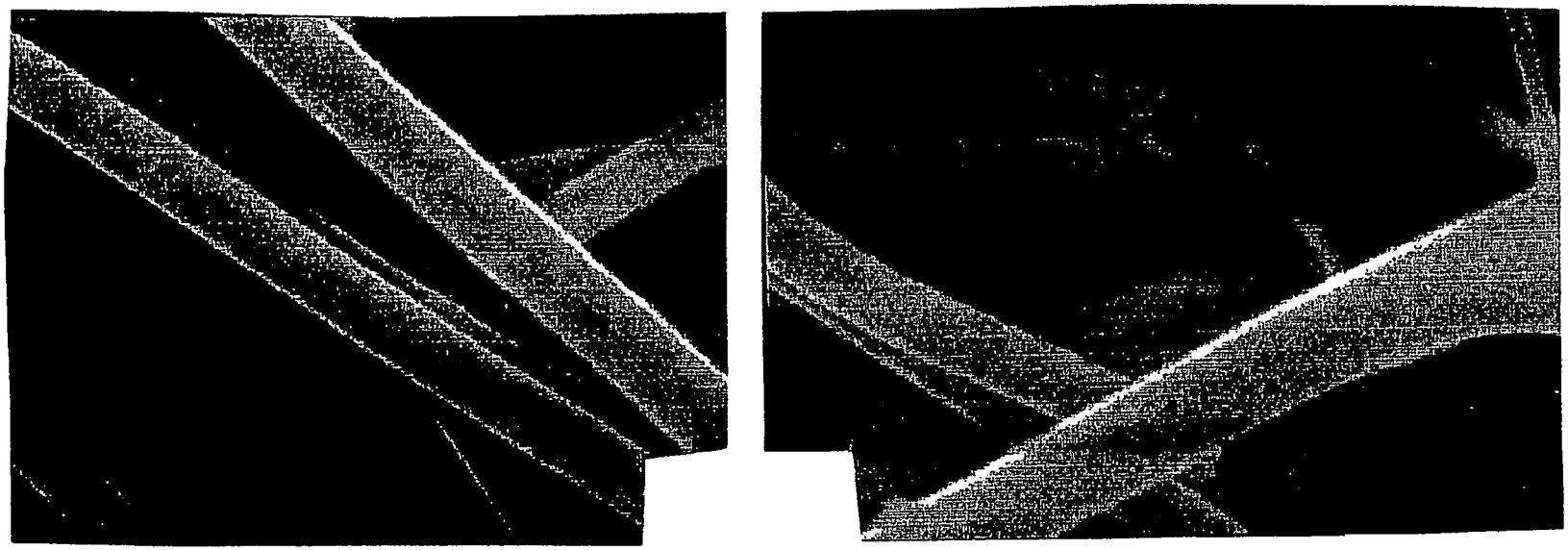
FIGS. 3-7 show fiber morphology under ambient conditions and under SCF processing at high pressures.
Figure 4:
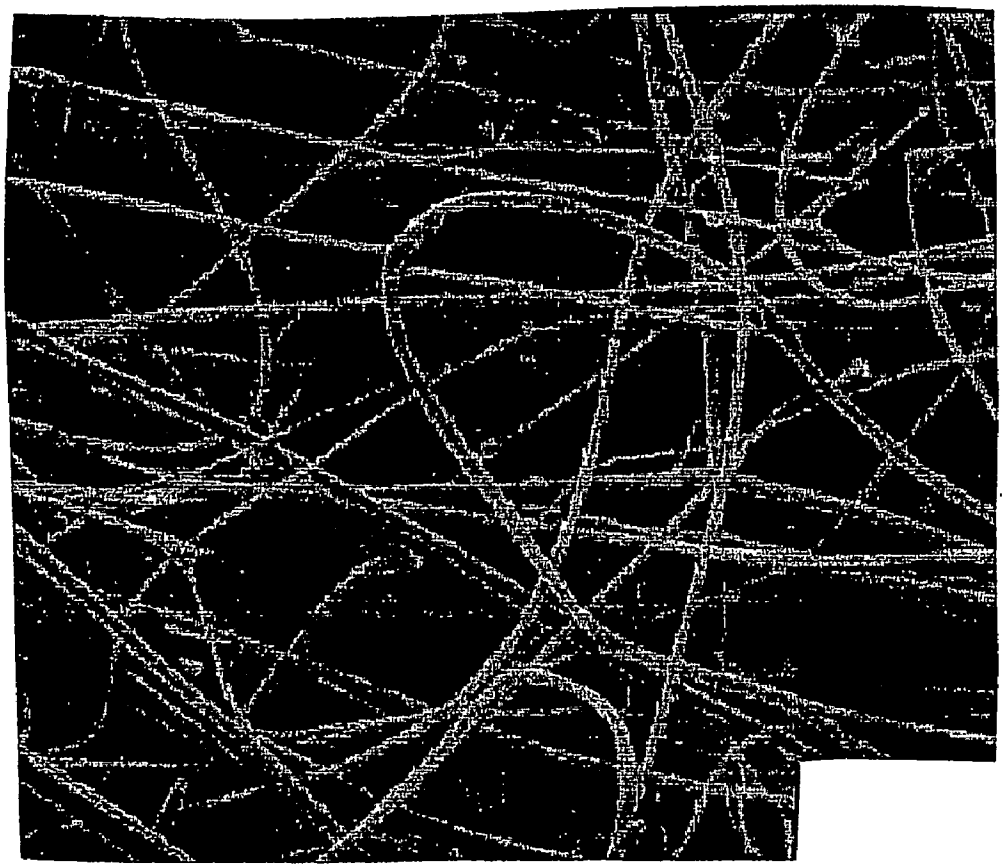
Figure 5:
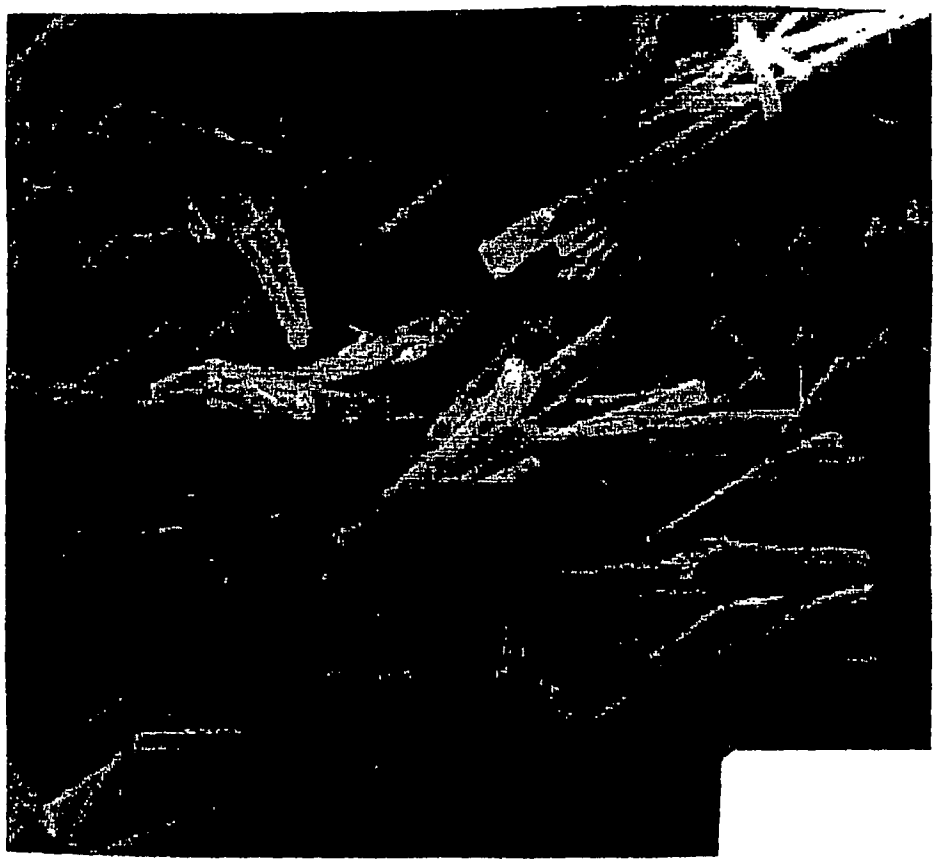
Figure 6:
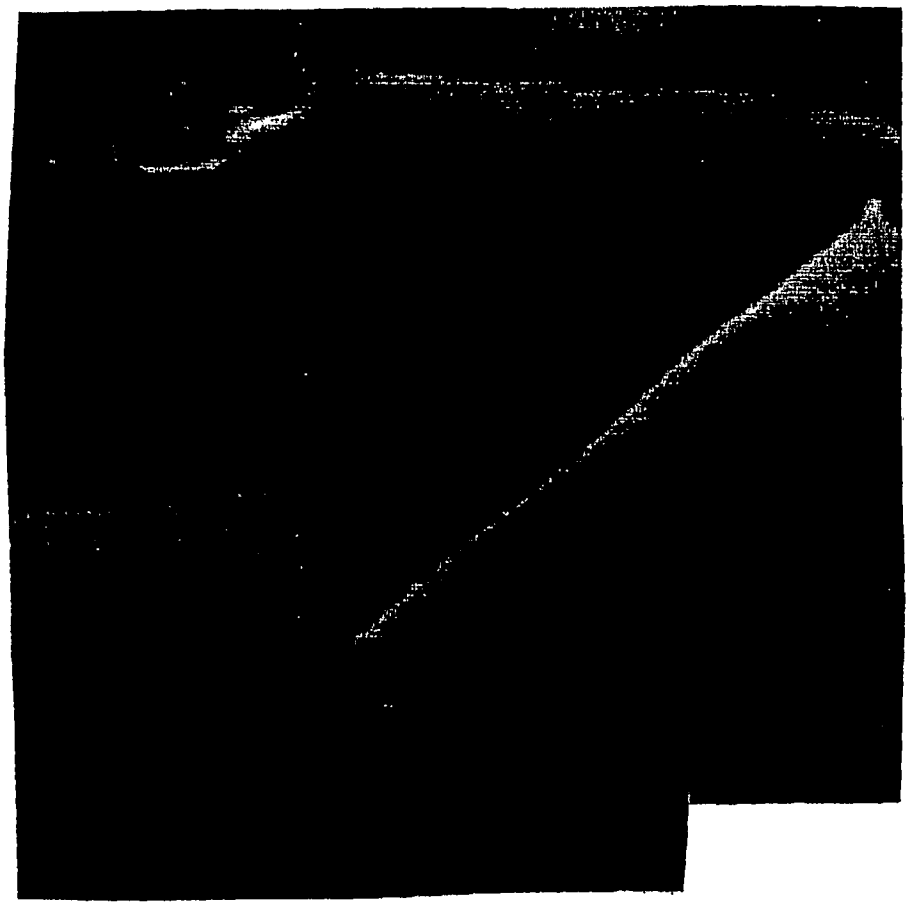
Figure 7:
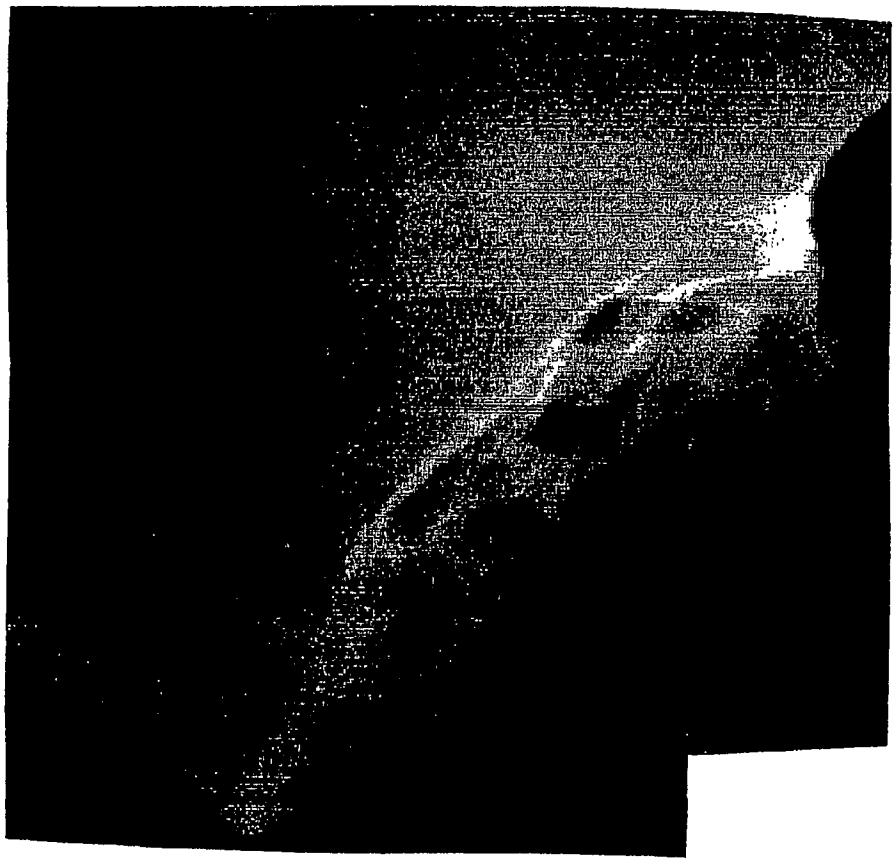

By way of a non-limiting example, the structures of polymeric fibers obtained by electrospinning under ambient conditions and under high pressure conditions in the presence of a SCF ($CO_2$) are shown in FIGS. 3-7. In FIGS. 3 and 4, the fibers were electrospun at ambient conditions in the absence of SCF. FIG. 3 shows smooth fibers at 2000× while FIG. 4 shows long, coherent fibers at 200×. FIGS. 5-7 show fibers electrospun at a pressure of 940 psia at room temperature and with $CO_2$ as the SCF. In FIG. 5, the fibers appear flatter rather than round (200×). In FIGS. 6 and 7, the fibers have an internal open-cell structure with outer skin (2000×). Electrospun fibers produced at high pressures using $CO_2$ exhibit an internal cell-like morphology with a coherent skin that is ruptured along the fiber axis in contrast to the fibers electrospun in the absence of an SCF and at ambient conditions.

As is generally known, the concentration of the fiber-forming polymer in the formulation is preferably sufficient so that randomly coiled polymeric molecules are overlapped and entangled in solution to form fibers. In a preferred embodiment, the formulations used for electrospinning contain about 3% to 60 wt. % polymer, more preferably about 5% to 50 wt. %, and most preferably about 10% to 45 wt. %. The lower concentrations can be used for polymers with very high molecular weights since these very high molecular weight polymers become overlapped and entangled in solution at low concentrations due to their very large dimensions. During the electrospinning process, the polymer formulation can be admixed with a sufficient amount of pressurized fluid or SCF to lower the viscosity of the formulation or pure polymer melt prior to entering the pressurized collection vessel through a flow tube, e.g., the formulation passed through the flow tube can be at a pressure at least 5 psi, preferably at least 10 psi, higher than the pressure inside the collection vessel. The collection vessel is preferably at a pressure of at least twice atmospheric pressure, more preferably at least 10 times atmospheric pressure, most preferably at least 20, 40 or 50 times atmospheric pressure, e.g., 50 to 300 times atmospheric pressure.

In a preferred embodiment, the electrospinning apparatus can be configured as illustrated in FIG. 1. A mixing vessel 10 contains the polymer formulation to be electrospun. The mixing vessel can be pressurized to provide subcritical or supercritical conditions if a pressurized fluid or SCF is to be introduced therein. The letter "P" represents a pressure gauge, "T" represents a temperature probe and "BPR" represents a back pressure regulator. The other elements of the apparatus in FIG. 1 include piston 15 for pressurizing the polymer formulation, $CO_2$ sources 20 for lowering viscosity of the polymer formulation or pressurizing the collection vessel, a pressure generator 25 for moving the piston, view ports 30, a spinning (collection) vessel 35, a target 36, a spinning needle 40 (flow tube), a camera/TV recorder 45, and a voltage source 50.

The stream of fiber from the sprayed polymeric solution is delivered to the target. Examples of a target include, but are not limited to, a wire mesh, a polymeric mesh, a rotating cylinder, a metal grid, metal foil, paper, a syringe needle, a decomposable substrate such as a decomposable polymer fiber, an electrospun substrate, and the like. The skilled artisan will be able to readily select other devices that can be employed to capture the fibers as they travel through the electric field. The target can be an electrically charged or grounded electrode which attracts the fibers or the target can be located between a suitably charged or grounded electrode and the flow tube. Depending on whether the target or electrode in the vicinity of the target is charged or grounded, the electric field to produce the electrospun fibers can be established by electrically charging or grounding the flow tube.

The target can be of different morphologies and geometries and the electrostatically produced fibers can acquire different spun geometries when dried. An example of a specific spun geometry may be a web of a single layer, multiple layer, interlaced fibers of different compositions, and the like.

EXAMPLES

In a series of experiments, a polymeric formulation (polyvinylpyrrolidone, Mw=58,000, Tg=160° C., 20.6 wt. % in $CH_2Cl_2$) was electrospun using the apparatus shown in FIG. 1 (voltage=20 kV). Conditions were varied as noted below.

Electrospinning at atmospheric conditions: the needle of an electrically grounded 5 mL syringe served as the flow tube, and a piece of high-pressure stainless steel (SS) tubing, ⅜ inch OD by 13⁄64 inch ID, served as the cathode. A glass test tube, approximately ½ OD by 6 inches long, covered the SS tubing and served as the target to collect fibers (FIG. 1). A syringe pump was used to push the liquid out from the needle at a constant flow rate of ~5 mL/hour.

The results in Table 1 demonstrate that the distance between the needle and the target is a variable for consideration when optimizing the electrospinning process.

TABLE 1

| Spinning time (min) | Weight of polymer collected (g) | Polymer fiber production rate (g/min) | Notes |
|---|---|---|---|
| 5 | 0.04 | 0.008 | The distance between the tip of the needle and the tip of the SS tubing (target) is 5 inches. Fibers cover approximately half of the target surface area. However, a significant amount of material is lost to the environment due to the large distance between the needle and the target. |
| 5 | 0.09 | 0.018 | The distance between the tip of the needle and the tip of the SS tubing is 15⁄16 inch. Fibers cover almost the whole surface of the target since now the target is much closer to the needle. |

Electrospinning with high-pressure equipment: the SS tubing, 1⁄16 inch OD by 0.030 inch ID, electrically connected with the spinning vessel and the metal parts of the apparatus, served as the ground. Copper tubing, approximately ¼ inch OD by ⅛ inch ID, connected to a spark plug served as the cathode. A test tube covered the copper tubing and served as the target to collect fibers. The distance between the tip of the SS tubing and the copper tubing was fixed at 15⁄16 inch. No spinning was observed if this distance is greater than one inch. Also, no spinning was observed for voltages below 15 kV. In the experiments where $CO_2$ is added to the spinning vessel, the pressure in the mixing vessel is increased by advancing the piston.

In a first set of experiments, the spinning vessel is open to the environment which means that no end caps were used in the vessel. The needle tubing and spark plug were suspended in the interior of the spinning vessel. Therefore, the system pressure is atmospheric in these instances. In this experimental configuration, the polymer solution did not spin fibers. Instead, the bulk of the solution dripped onto the interior surface of the vessel even when the distance between the needle and target was placed 15⁄16 inch apart. However, a very small fraction of the polymer solution did hit the target during the spinning operation and produced a very small amount of fiber.

Table 2 shows the results where the needle tubing and the spark plug fit into the vessel end caps so that the spinning vessel can be pressurized with $CO_2$. There is no $CO_2$ in the mixing vessel of the apparatus. These experiments demonstrate that fibers can be obtained if there is sufficient $CO_2$ pressure in the spinning vessel. The percentage of polymer solution that hits the target as fiber increases as the $CO_2$ pressure in the spinning vessel increases.

TABLE 2

| T Spinning vessel (° C.) | $CO_2$ Pressure in the spinning vessel (psig) | P Mixing vessel (psig) | Spinning time (min) | Weight polymer collected (g) | Polymer fiber production rate (g/min) | Notes |
|---|---|---|---|---|---|---|
| ~22 | Zero | 20 | 5 | 0.03 | 0.006 | Only a small amount of polymer reaches the target as fibers. The majority of polymer on the target is from droplets sprayed from the needle. |
| ~22 | 200 | 250 | 5 | 0.06 | 0.012 | Only a small amount of polymer reaches the target as fiber. Some of the polymer on the target is from droplets sprayed from the needle. |
| ~22 | 500 | 550 | 5 | 0.03 | 0.006 | More polymer reaches the target as fiber compared to experiments which have a lower $CO_2$ pressure in the spinning vessel. Some of the polymer on the target is from a large droplet sprayed from the needle. |
| ~22 | 940 | 1000 | 5 | 0.04 | 0.008 | At this $CO_2$ pressure in the spinning vessel, most of the polymer solution reaches the target as fibers. |
| ~22 | 780 | 880 | 5 | 0.02 | 0.004 | Here the pressure in the spinning vessel is lower. A smaller amount of fibers reach the target. |
| 40 | 1100 | 1200 | 6 | 0.07 | 0.014 | The majority of polymers on the target are in the form of fibers. |
| ~22 | 950 | 1000 | 2 | 0.01 | 0.005 | Experiment run only for 1 minute. the majority of polymer on the target is in the form of fibers. |
| ~22 | 950 | 1000 | 5 | 0.04 | 0.008 | The majority of polymer on the target is in the form of fibers. |

Electrospinning with high pressure in mixing vessel and spinning vessel: for these examples, $CO_2$ was added to the mixing vessel of the apparatus as well as the spinning vessel of the apparatus.

TABLE 3

| T Spinning vessel (° C.) | $CO_2$ Pressure in the spinning vessel (psig) | P Mixing vessel (psig) | Spinning time (min) | Weight polymer collected (g) | Polymer fiber production rate (g/min) | Notes |
|---|---|---|---|---|---|---|
| ~22 | 940 | 1000 | 5.3 | 0.02 | 0.004 | The majority of polymer on the test tube is fibers. |
| ~22 | 930 | 1000 | 10 | 0.08 | 0.008 | The majority of polymer on the test tube is fibers. |

Figure 2:
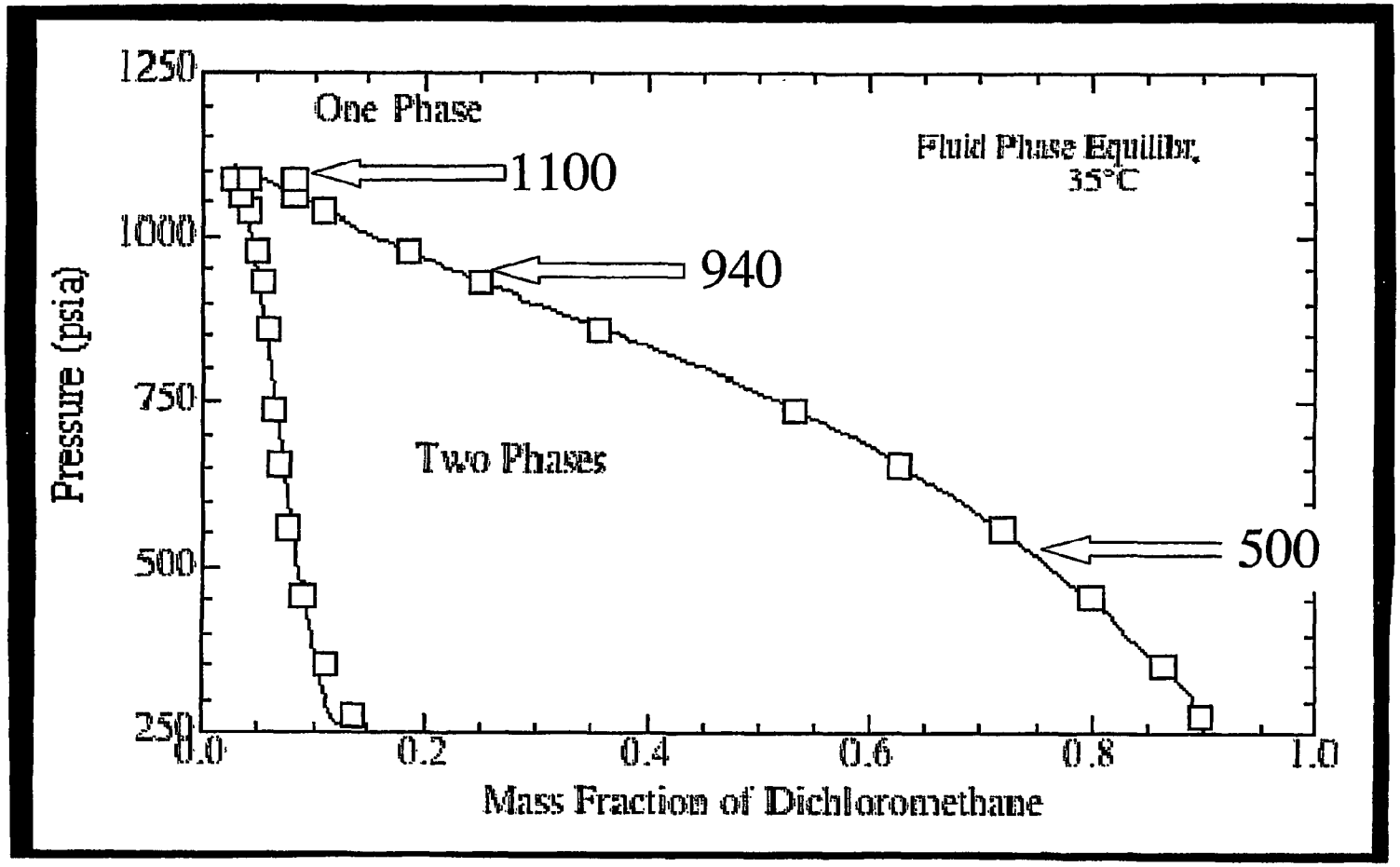
FIG. 2 shows a graph of the solubility behavior of dichloromethane solvent and supercritical $CO_2$ at various pressures.

FIG. 2 is a graph showing the impact of pressure on the phase behavior of a $CH_2Cl_2/CO_2$ system published by Tsivintzelis and coworkers (Fluid Phase Equilibria, Vol. 224, pp 89-96 (2004). As pressure increases, the solubility of $CH_2Cl_2$ in $CO_2$ increases. At lower temperatures, less pressure can be used to attain a single phase.

The term "essentially free of" as used above and in the following claims is intended to encompass amounts of residual organic solvents which do not adversely affect the properties of the electrospun fibers. Generally, any residual amount of the organic solvent in the fibers is preferably less than about 5% by weight of the fiber, more preferably less than about 1% by weight, and most preferably less than about 0.5 wt. %.

The above are exemplary modes of carrying out the invention and are not intended to be limiting. It will be apparent that modifications thereto can be made without departure from the spirit and scope of the invention as set forth in the accompanying claims.

What is claimed is:

1. A polymer fiber electrospinning method, comprising:

pressurizing a collection vessel to a pressure at least twice atmospheric pressure; and electrospinning a pressurized polymer formulation optionally containing an organic solvent into said collection vessel such that polymer fibers are formed essentially free of said organic optional solvent.

2. The method of claim 1, wherein the pressure in the collection vessel ranges from about 50 psig to about 10,000 psig.

3. The method of claim 2, wherein the pressure ranges from about 50 psig to about 3000 psig.

4. The method of claim 1, wherein the temperature in the collection vessel ranges from about 10° C. to about 200° C.

5. The method of claim 4, wherein the temperature ranges from about 20° C. to about 60° C.

6. The method of claim 1, wherein the pressurizing step is performed using a pressurized fluid selected from the group consisting of carbon dioxide, nitrous oxide, alkanes, alkenes, ammonia, ethers, noble gases, $SF_6$, water and halogenated hydrocarbons.

7. The method of claim 1, wherein the pressure in the collection vessel is less than the pressure applied to the polymer formulation.

8. The method of claim 1, wherein the polymer is selected from the group consisting of polyolefins, polyesters, polyamides, polyurethanes, vinyl polymers, elastomers, fluorinated polymers, polyethers, heterocyclic polymers and polyvinyl pyrrolidone or mixture thereof.

9. The method of claim 1, wherein the polymer formulation contains at least one organic solvent and/or contains a pressurized or supercritical fluid.

10. A method of preparing polymeric fibers comprising:

(a) forming polymeric fibers by electrospinning a liquid polymeric formulation comprising a fiber-forming polymer and an optional organic solvent for the polymer into a collection vessel containing a pressurized fluid wherein said collection vessel is pressurized by said pressurized fluid to a pressure at least twice atmospheric pressure;

(b) contacting the polymeric fibers with the pressurized fluid in the collection vessel and optionally extracting the organic solvent into the pressurized fluid; and (c) recovering polymeric fibers which are essentially free of said optional organic solvent.

11. The method of claim 10, further comprising introducing a pressurized fluid into a mixing vessel containing the polymeric formulation prior to electrospinning the polymeric formulation into the collection vessel, the polymeric formulation comprising a fiber forming polymer and at least one organic solvent or a pure polymer melt.

12. The method of claim 10, wherein the pressure in the collection vessel ranges from about 50 psig to about 10,000 psig and the temperature in the collection vessel ranges from about 10° C. to about 200° C.

13. The method of claim 12, wherein the pressure in the collection vessel ranges from about 50 psig to about 3000 psig and the temperature ranges from about 20° C. to about 60° C.

14. The method of claim 10, wherein the recovered polymeric fibers are nano-fibers and/or micro-fibers.

15. The method of claim 10, wherein the pressurized fluid is selected from the group consisting of carbon dioxide, nitrous oxide, alkanes, alkenes, ammonia, ethers, noble gases, $SF_6$, water and halogenated hydrocarbons.

16. The method of claim 15, wherein the pressurized fluid is carbon dioxide in a supercritical or a subcritical state.

17. The method of claim 10, wherein the fiber-forming polymer is selected from the group consisting of polyolefins, polyesters, polyamides, polyurethanes, vinyl polymers, elastomers, fluorinated polymers, polyethers, and heterocyclic polymers and polyvinylpyrrolidone or mixture thereof.

18. The method of claim 10, wherein the organic solvent is non-volatile at ambient temperatures and pressures.

19. The method of claim 10, wherein the pressure in the collection vessel is less than a pressure applied to the polymeric formulation to deliver the polymeric formulation into the collection vessel.

20. An electrospinning apparatus, comprising:

a source of a pressurized polymeric formulation;

a collection vessel which is pressurized to at least twice atmospheric pressure by a pressurized fluid supplied to an interior of the collection vessel;

a flow tube in fluid communication with the source of pressurized polymeric formulation and through which the pressurized polymeric formulation is delivered into the interior of the collection vessel;

a target in the collection vessel on which the pressurized polymeric formulation is electrospun into fibers; and a voltage source establishing an electric field between the flow tube and the target.

21. The apparatus of claim 20, further comprising a source of pressurized fluid in fluid communication with the interior of the collection vessel.

22. The apparatus of claim 21, wherein the pressurized fluid is a supercritical fluid.

23. The apparatus of claim 20, wherein the interior of the collection vessel contains supercritical carbon dioxide and the source of the pressurized polymeric formulation is a pressurized mixing vessel in fluid communication with the flow tube.

24. The apparatus of claim 20, wherein the source of pressurized polymeric formulation supplies the pressurized polymeric formulation at a constant flow rate to the flow tube.

25. The apparatus of claim 23, wherein the source of pressurized polymeric formulation supplies the polymeric formulation to the flow tube at a pressure at least 5 psi greater than the pressure in the interior of the collection vessel.

26. The apparatus of claim 20, wherein the flow tube is electrically grounded and the voltage source comprises an electrically charged electrode in the vicinity of the target.

* * * * *